United States Patent [19]

Pickles

[11] Patent Number: 4,857,018

[45] Date of Patent: Aug. 15, 1989

[54] COMPLIANT PIN HAVING IMPROVED ADAPTABILITY

[75] Inventor: Charles S. Pickles, Hummelstown, Pa.

[73] Assignee: AMP Incorporated, Harrisburg, Pa.

[21] Appl. No.: 239,561

[22] Filed: Sep. 1, 1988

[51] Int. Cl.[4] ..... H01R 13/428

[52] U.S. Cl. ..... 439/751; 439/82

[58] Field of Search ..... 439/82, 751, 825–827, 439/873

[56] References Cited

U.S. PATENT DOCUMENTS

| | | | |
|---|---|---|---|
| 3,634,819 | 1/1972 | Evans . | |
| 4,186,982 | 2/1980 | Cobaugh et al. . | |
| 4,206,964 | 6/1980 | Olsson . | |
| 4,606,589 | 8/1986 | Elsbree, Jr. et al. . | |
| 4,655,537 | 4/1987 | Andrews, Jr. . | |
| 4,676,579 | 6/1987 | Ting | 439/82 |
| 4,743,081 | 5/1988 | Cobaugh | 439/751 |

FOREIGN PATENT DOCUMENTS

| | | | |
|---|---|---|---|
| 68656 | 1/1983 | European Pat. Off. | 439/751 |

*Primary Examiner*—Gary F. Paumen
*Attorney, Agent, or Firm*—Allan B. Osborne

[57] ABSTRACT

Contact pin has a compliant portion having two spaced-apart openings therein at locations adjacent to the ends of the compliant portion. The compliant portion is sheared along a shear line extending axially between the openings. The shear line divides the compliant portion into two side-by-side beams. The beams are displaced in opposite first directions away from the axis of the pins. The openings and the shear line define ears on each beam which extend towards the other beam. When the compliant portion is inserted into a circuit board hole, the ears are moved into overlapping relationship and the compliant portions are flexed in second opposite directions which are normal to the first opposite directions. The ears of each beam function as an intermediate support for the other beam. A high degree of adaptability as regards stock thickness and dimensions of the pin is achieved by virtue of the fact that the beams are flexed parallel to their major surfaces and are supported intermediate their ends by the ears.

18 Claims, 4 Drawing Sheets

COMPLIANT PIN HAVING IMPROVED ADAPTABILITY

FIELD OF THE INVENTION

This invention relates to contact pins of the type which are intended for insertion into circuit board holes and which have compliant portions that are deformed when inserted into the circuit board hole and which establish electrical contact with conductive surface portions of the hole.

BACKGROUND OF THE INVENTION

Compliant pins are now being used in vast numbers in the electronics industry when it is necessary to establish contact with the conductors in a multi-layer board, a back panel, or a simple circuit board having a plated through hole. A compliant contact pin has a compliant portion which has a normal width which is greater than the hole diameter but which can be deformed when it moves into the circuit board hole so that contact edge portions of the compliant portion will establish the electrical contact required with the conductors in the circuit board hole. The compliant portion thus is essentially a relatively stiff spring system which, after insertion into the circuit board hole, will bear against the surfaces of the hole with sufficient force to retain the pin in the circuit board and to establish a sound electrical contact with the circuit board conductors. Some commonly known types of compliant pins are shown, for example, in U.S. Pat. Nos. 4,186,982, 4,743,081, 4,206,964, and 4,606,589.

Notwithstanding the fact that compliant pins are presently being used in large numbers, there are many circumstances under which it would be desirable to employ compliant pin technology but in which it is not now feasible to do so for the reason that most of the presently known types of compliant pins lack adaptability in the sense that the compliant pin must be manufactured from metal stock having some minimum thickness and the pin will not perform adequately if an attempt is made to manufacture the pin from a stock metal which is thinner than the required minimum. For example, a widely used standard sized hole for circuit boards or other panel-like members in which contact pins are mounted is 0.040 inches (1.02 mm). Many of the presently available compliant pins are manufactured from metal stock having a thickness of 0.025 inches (0.63 mm) if the pin is intended for insertion into a 0.040 inch diameter hole. Some presently available compliant pins can be produced from metal stock having a thickness of 0.015 inches (0.38 mm) but with some sacrifice of performance. Presently available contact pins thus have only limited adaptability insofar as the hole diameter and stock thickness relationships are concerned.

There are many circumstances where a contact pin must be inserted into a 0.040 inch (1.02 mm) diameter hole but where it is impossible to use 0.025 inch thick stock or even 0.015 inch (0.38 mm) stock for the pin. Manufacturing cost considerations alone may limit the thickness of the stock to 0.012 inches (0.30 mm) or less. The stock thickness for a contact pin may also be limited if the contact pin is integral with a spring receptacle or the like which must, for mechanical reasons, be manufactured from relatively thin stock metal. Circuit board switches such as DIP switches, for example, contain spring contacts which must be manufactured from extremely thin stock metal, say 0.008 inches (0.20 mm). It would be desirable if the pin portion of the spring contacts could be provided with a compliant portion so that the DIP switch could be mounted on the circuit board by merely inserting the contact pins which extend from the switch housing into circuit board holes. At present, if the circuit board hole size is the standard 0.040 inches as noted above, and if the spring contact is of relatively thin material, the connector or switch must be connected to the circuit board conductors by conventional soldering methods with a significant increase in assembly cost over comparable compliant pin assembly methods.

Some reduction in the stock thickness of a compliant pin might be obtained if special manufacturing techniques such as coining are resorted to, but such techniques would increase manufacturing cost. The preferred method of manufacturing compliant pins is by simple stamping and forming methods.

The present invention is directed to the achievement of an improved compliant pin which has a wide range of adaptability in the sense that the pin can be manufactured from metal stock having a wide thickness range. The invention is also directed to the achievement of a compliant pin which can be manufactured by conventional known stamping and forming methods and which does not require highly critical and sensitive metal working steps in its production.

THE INVENTION

The invention comprises a contact pin which is intended to be inserted into a circuit board hole, the pin having a compliant portion which is deformed upon insertion and which establishes contact with conductive surface portions of the hole after insertion. The contact pin is characterized in that the compliant portion has a lead-in portion, an intermediate portion, and a trailing end portion. The intermediate portion has a width which is greater than the diameter of the circuit board hole and the lead-in portion has a width which is less than the diameter of the circuit board hole. The compliant portion is of increasing width between the lead-in portion and the intermediate portion. The compliant portion has a pair of spaced-apart openings therein, one of the openings being proximate to the lead-in portion and the other opening being proximate to the trailing end portion. The compliant portion is sheared along a shear line which extends between the openings so that the openings and the shear line divides the compliant portion into a pair of side-by-side beams. Each beam has an intermediate portion, one fixed end at the lead-in portion, and another fixed end at the trailing end portion. Each beam has a stop in the form of an ear which extends from its intermediate portion towards the other beam. The ears are defined by the edges of the openings and the shear line. The intermediate portions of the beams, including the ears, are displaced by a forming operation in first opposite directions normally of the longitudinal axis of the pin and away from each other thus placing the ears in spaced-apart planes. In use, and upon movement of the compliant portion into the circuit board hole, lead-in portion first, the beams are moved towards each other in second opposite directions. The second directions are normal to the first directions and the ears are thereby moved into overlapping relationship so that the ear of each beam functions as a support or stop for the other beam at a location intermediate the ends of the other beam. Upon further movement of the compliant portion into the circuit board hole, the beams are moved additional distances in the second opposite directions and flexed, the flexure of the beams giving rise to contact forces of the beams with the conductive surface portions of the hole. Advantageously, the contact pin as described above is a stamped and formed pin having oppositely facing rolled surfaces and sheared side edges and the openings in the compliant portion extend through the rolled surfaces. The intermediate portions of the beams may be in substantially parallel spaced-apart planes prior to insertion of the pin into the circuit board hole or they may be in opposed offset concave relationship.

THE DRAWING FIGURES

Figure 3:
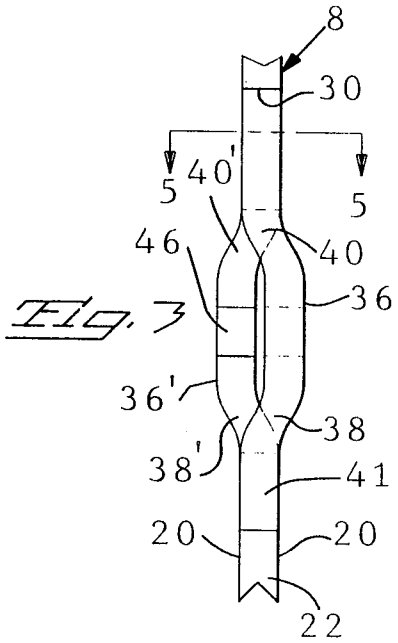
FIG. 3 is a side view looking in the direction of the arrows 3—3 of FIG. 2.
Figure 5:
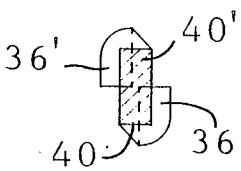
Figure 2:
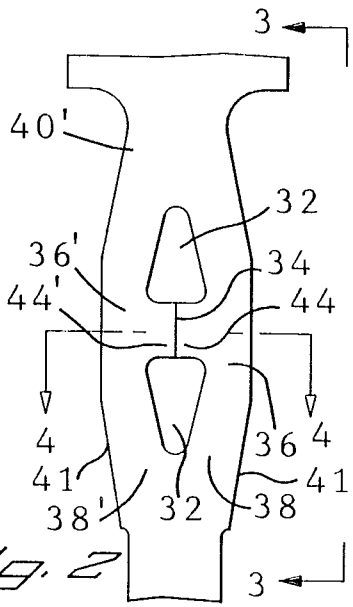
FIG. 2 is a frontal view of the compliant portion of the contact pin of FIG. 1.
Figure 4:
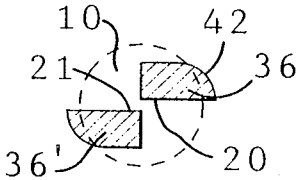
Figure 1:
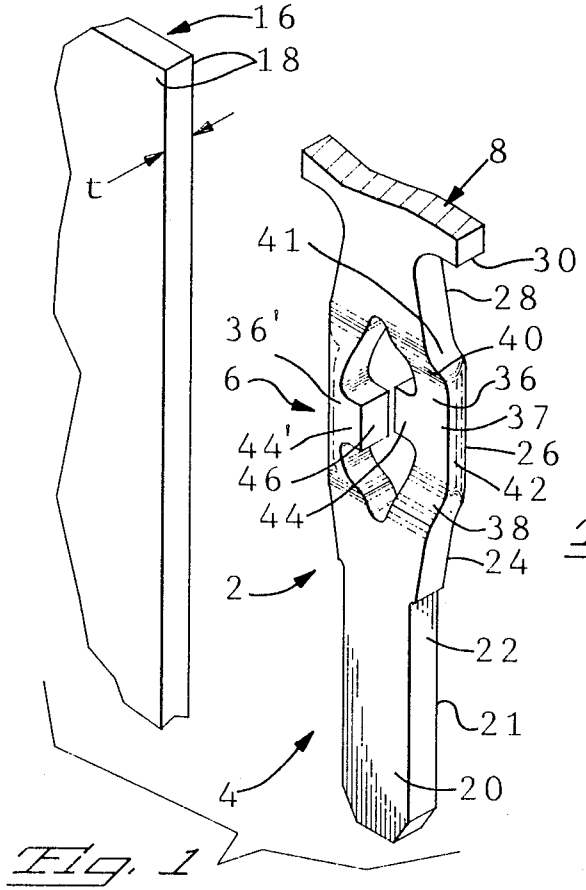
FIG. 1 is a perspective view of a contact pin in accordance with the invention and shows also a short section of strip stock metal.

FIGS. 4 and 5 are views looking in the direction of the arrows 4—4 and 5—5 of FIGS. 2 and 3 respectively FIGS. 6, 7, 9, and 10 are views illustrating the movement of the compliant portion into a circuit board hole and illustrating the manner in which the compliant portion is flexed during such movement.

Figures 6, 7, 8, 9, 10, 11:
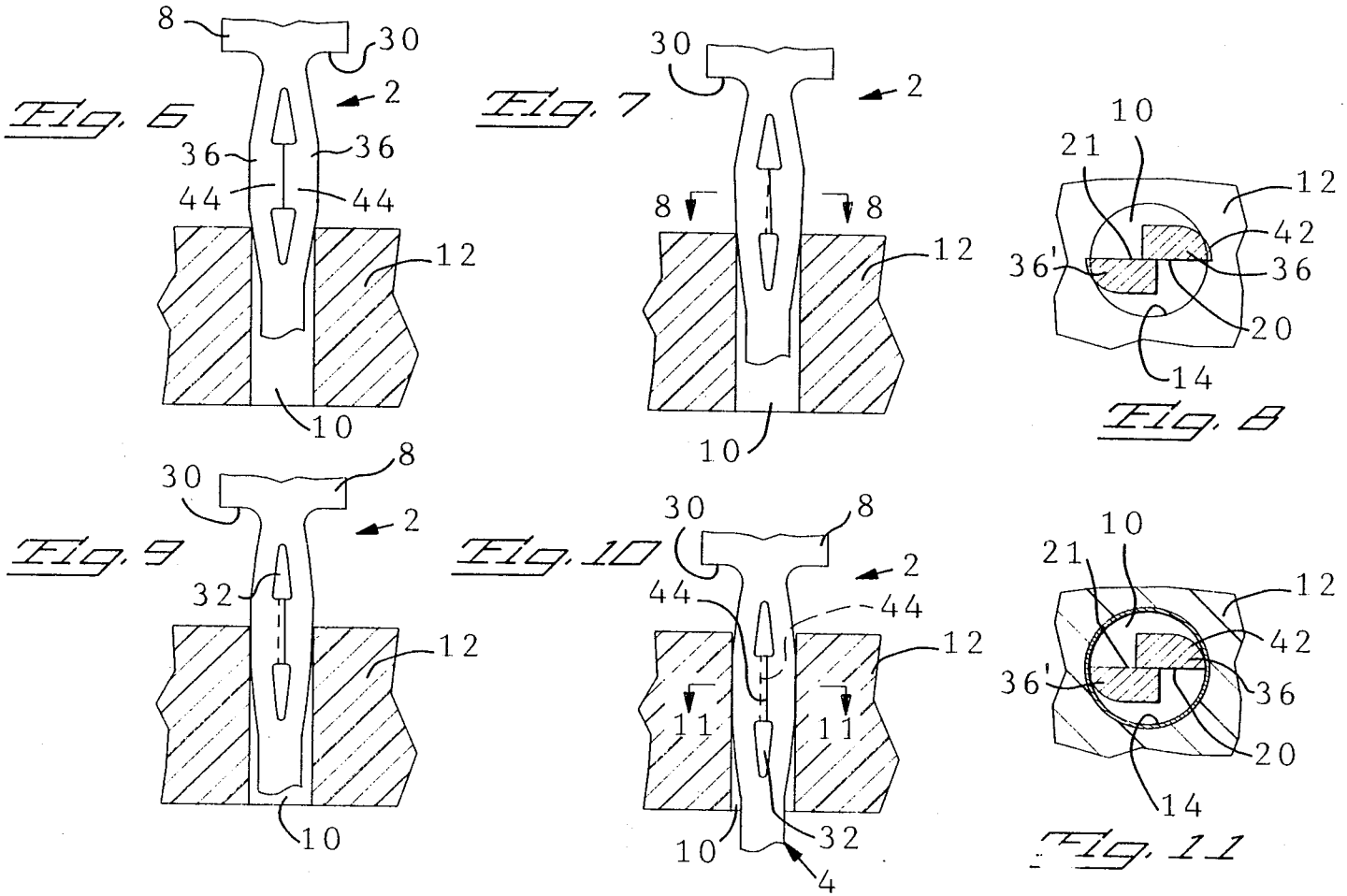

FIGS. 8 and 11 are views looking in the direction of the arrows 8—8 and 11—11 of FIGS. 7 and 10 respectively.

FIGS. 12-16 are views showing alternative compliant portions of contact pins.

Figure 17:
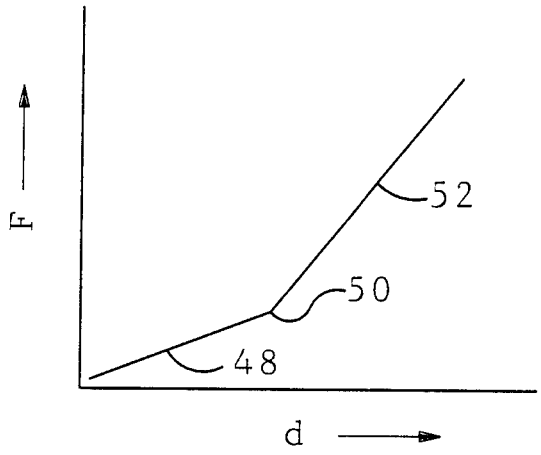

FIG. 17 is a theoretical curve of the force and insertion distance relationships of a contact compliant pin in accordance with the invention.

Figure 18:
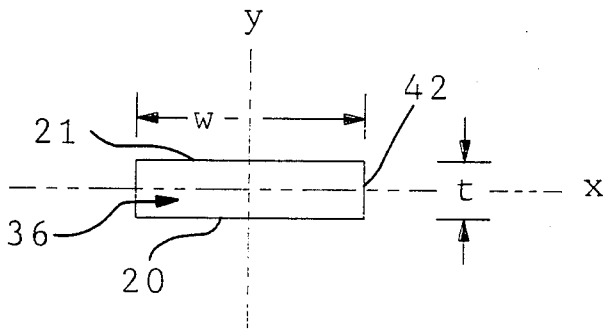

FIG. 18 is a cross-sectional view of one of the beams which forms part of the compliant portion of the contact pin and is used for purposes of explanation.

THE DISCLOSED EMBODIMENT

Referring to FIGS. 1–5, a contact pin 2 in accordance with the invention has a pilot portion 4, a compliant portion 6, and an adjacent portion 8. The pin is intended to be inserted into a hole 10 in a circuit board 12 which has metalized surface portions 14 so that contact will be established with these metalized portions by the compliant portion of the pin 2. The pilot portion 4 has a cross-section such that it will fit freely through the hole and the compliant portion is deformed when it enters the hole as will be described below.

The embodiment of the invention shown in FIGS. 1–5 is manufactured by stamping and forming sheet metal stock 16 which has oppositely facing rolled surfaces 18 and which has a thickness t. The rolled surfaces 18 are so called for the reason that they were contacted and squeezed between the rolls when the stock metal was formed. The rolled surfaces are also identified in the stamped and formed pin which has also sheared edge surfaces as described below.

The pin 2 has oppositely facing rolled surfaces 20, 21 extending along its length and sheared edges as shown at 22. The compliant portion 6 has a lead-in portion 24 which is adjacent to the pilot portion of the pin, a first intermediate portion 26, and a trailing end portion 28 which adjoins the adjacent portion 8 of the pin. The adjacent portion has a downwardly facing shoulder 30 which functions as a stop when the pin is inserted into the circuit board and insures that the compliant portion will be in the circuit board hole as shown in FIG. 11.

Two punched triangular openings 32 are provided in the compliant portion, and the compliant portion is sheared along a shear line 34 which extends between these openings. The shear line 34 lies on the longitudinal axis of the pin. The openings are generally triangular and have apices which are proximate to the lead-in portion and the trailing end portion respectively and have bases which intersect the shear line 34. The openings and the shear line divide the compliant portion into two side-by-side beams 36, 36' which are on each side of the longitudinal axis the pin. Each beam has one fixed end 38, 38' at the lead-in portion and another fixed end 40, 40' at the trailing end portion. Each beam also has an outwardly facing sheared edge 41 which is chamfered in the intermediate portion as shown at 42 so that these edges will conform to the cylindrical surface of the circuit board hole 10.

The holes 32 and the shear line 34 define a pair of ears 44, 44' which extend from each beam intermediate its ends toward the other beam. The ears have opposed ends 46 which are on the central axis of the pin and which are the sheared surfaces resulting from the shearing of the pin when the beams were produced.

The central or second intermediate, portions 37 of the beams 36 are formed in first opposite directions away from each other so that after forming, the intermediate portions 37 of the beams and the ears 44, 44' are in parallel spaced-apart planes as shown in FIG. 3. The portions of the rolled surfaces 20, 21 on the ears 44, 44' are opposed to each other as shown in FIG. 4 and the ends 46 of the ears are coplanar. The manufacturing process for producing the pin 2 is thus extremely simple requiring only the blanking, hole punching, shearing of the shear line 34, and the forming of the beams by bending them in the opposite first directions.

When the pin is inserted into the circuit board hole 10, it is aligned with the hole and the pilot portion 4 is moved into the hole until the lead-in portion of the compliant portion engages the upper edges of the hole. Because of the fact that the central portions of the beams are offset, the corners 42, 42' will engage edge portions of the hole at opposite locations. As insertion proceeds, the beams will be moved diagonally towards each other and into overlapping relationship as shown in FIG. 7. That is, the beams will be moved in first reverse directions which are the reverse of the first opposite directions back towards their original positions that they occupied prior to forming. At the same time, the beams will be moved in second opposite directions which are normal to the first opposite directions so that the beams move into overlapping relationship as indicated by the dotted line in FIG. 7. The resultant movement is diagonal, as explained above, of the beams towards each other.

After the ears overlap each other as shown in FIG. 7 even by a slight amount, further movement of the beams in the first reverse directions, that is back to their original positions, is impeded or stopped entirely and further flexure of the beams takes place in the second opposite directions. In other words, the beams move further into overlapping relationship as shown in FIG. 9 and are flexed along their lengths during this stage of the insertion. When the beams are fully inserted, FIGS. 10 and 11, the contact surfaces 42 are urged against the conductive surface portions of the circuit board hole 10 by stresses in the beams which result from the flexure of the beams in the second opposite directions and the flexure of the beams in the first reverse directions.

The movement of the beams in the first reverse directions as discussed above may be extremely slight and may be insignificant as compared to the movement of the beams in the second opposite directions. If a particular pin is designed such that there is a gap between the surfaces 20,21, there will be significant movement in the first reverse directions but if there is no gap, the movement in the first reverse directions will be insignificant. In all cases, there must be sufficient movement in the second opposite directions at the outset of the insertion process to bring the ears into overlapping relationship so that the ears will not be returned to coplanarity by movement of the ears in the first reverse directions.

An important feature of the invention is that when the ears 44, 44' move into overlapping abutting relationship as shown in FIGS. 7 and 8 and the surfaces 20, 21 in FIG. 4 are against each other, the ear of each beam acts as a support for the other beam at a location intermediate the ends of the other beam. In the fully inserted terminal then, the compliant portion of the pin comprises two beams which are each fixed at their ends which are supported intermediate their ends, and the beams are flexed in a manner which produces the contact force at the electrical interface of the surfaces 42 of the pins and the conductive surface portions of the circuit board hole. A beam which is fixed at its ends and which is also supported intermediate its ends is an extremely strong structural member and by virtue of this fact, high contact forces can be obtained even if the pin is manufactured from a relatively thin stock metal 16.

The total contact force which is exerted by the compliant portion on the conductive surface of the circuit board hole is made up of the forces resulting from flexure of the beams 36, 36' as discussed above and, it is believed, from the friction which is produced when the opposed surfaces 20, 21 of the ears 44, 44' move against each other and into overlapping relationship as shown in FIGS. 7–11. The importance of a frictional force contribution (in addition to the force resulting from flexure) to the success of compliant pin technology is discussed in U.S. Pat. No. 4,186,982 and most, if not all, of the presently used compliant pins develop their contact forces from the two sources, flexure and friction A compliant pin in accordance with the present invention provides a high degree of control over the frictional force contribution to the total contact force exerted by the pin on the circuit board hole. The onset of the development of the frictional force contribution can be delayed until an intermediate portion of the insertion process by providing a gap between the surfaces 20, 21 of the ears so that the ears do not contact each other until an intermediate stage of the insertion process. The normal force between the surfaces 20, 21 can be varied, and the frictional contribution thereby varied, by varying the amount of chamfer on the contact surfaces 42. Additionally, the coefficient of friction of the surfaces 20, 21 can be increased or decreased thereby to increase or decrease the frictional contribution FIG. 17 is an idealized curve which illustrates the force developed by the compliant portion as insertion proceeds, the force being indicated by the vertical axis as F and the insertion distance being indicated by d on the horizontal axis. FIG. 17 is not based on actual test data and no values have been assigned to F and d. An actual curve might differ from FIG. 17 with regard to slope and the location of the transition 50 discussed below but most actual curves would have the essential characteristics of FIG. 17. FIG. 17 is presented here for purposes of explanation.

The portion 48 of the curve of FIG. 17 represents the period during which the beams are moved diagonal towards each other and the gap, if any, between the surfaces 20, 21 is closed. The transition 50 of the curve represents the abrupt change in the slope of the curve when the surfaces 20, 21 abut each other and the beams are stiffened by the intermediate support provided for each beam by the projecting ear of the other beam. The final portion 52 of the curve represents the final stages of insertion when the beams are flexed in the second opposite directions towards each other and along their lengths. This mode of flexure provides a large portion of the total force F which is exerted by the compliant portion of the pin on the conductive surfaces of the hole. The frictional force contribution to the total contact force F of the inserted pin would be developed at a time beginning at the transition 50 of the curve and would contribute to the total force during the portion represented by 52.

A salient advantage of a pin in accordance with the invention is that it is adaptable in the sense that a high performance compliant pin can be produced from metal stock having a wide thickness range, that is, from relatively thin stock or comparatively thick stock. This advantage can be understood a further discussion of FIG. 17. If the curve of this FIG. is assumed to be an ideal curve for a particular compliant pin to be used under a particular set of circumstances, the curve can be produced with relatively thin or relatively thick stock by merely varying certain dimensions in the pin as will be discussed below. Alternatively, if the stock thickness is fixed by considerations other than the performance and design of the compliant portion of the pin, the ideal curve of FIG. 17 can be achieved or curves having different slopes or values can also be achieved if required. For example, if a relatively low push-in force (the force required to insert the compliant portion into the hole) is required for any reason, the dimensions of parts of the compliant portion of the pin can be changed to yield a lower value of F.

The adaptability of the invention stems in a large part from the fact that the beams are flexed in the second parallel directions towards each other and past the central axis of the pin during the final stages of the insertion process. This flexure is parallel to the wide dimension or the width W of the beam indicated in FIG. 18 which shows the cross-section of the beam 36 and indicates the x and y axes (major axis and the minor axis respectively) of the beam. The strength of the beam when it is flexed by a load applied along its x axis, that is parallel to the rolled surfaces 20, 21, is determined by the moment of inertia $I_y$ respect to the y axis of FIG. 18. The formula for $I_y$ as follows:

$$I_y = \frac{W^3 t}{12}$$

Since the width W is cubed in formula, a large change in the thickness t of the beam little effect on the final value of the moment of inertia $I_y$ and a minor change in the width W will compensate for a comparatively large change in the thickness t. This means that if the thickness t is reduced by a substantial amount, $I_y$ will remain the same if the width is increased by a comparatively small amount and strength of the beam will not be changed significantly. It follows that if the compliant pin shown in FIGS. 1–5 were to be produced from a metal stock considerably thinner than the stock shown in FIGS. 1–5, (stock having a reduced thickness t), it would only be necessary to increase the widths W of the beams in order compensate for the thinner stock metal. The width W of the beams 36, 36' can be increased by reducing the size of the holes 32 or by using holes of other configurations as shown in FIGS. 12–16 and described below. Alternatively, if it is assumed that a pin must have thickness indicated in FIGS. 1–5 but must have a lower insertion force and a lower contact force F, the holes 32 can be made larger in order to achieve the desired results.

By way of comparison, if the beam as shown in FIG. 18 were to be flexed normally the rolled surfaces 20, 21 rather than parallel to the surface, the moment of inertia with respect to the $I_x$ would, to a large part, determine the strength of the beam. The formula for $I_x$ is as follows:

$$I_x = \frac{W^3 t}{12}$$

In this formula, the t dimension is cubed and the W dimension is not. If the t is diminished, the W dimension must be increased by substantial amount if the strength of the resulting pin is to remain constant.

The foregoing discussion is presented as an aid to an understanding of the advantages of the invention and is not intended as a basis for calculations regarding the performance of a particular pin in accordance with the invention. The discussion assumes that the beams 36, 36' have rectangular cross-sections, a condition which may not exist in an actual pin (as in the pin 2 which has beams 36, 36' that chamfered corners). The moment of inertia of an actual compliant pin will not, therefore, be in precise accordance with the formula set forth above. However, the formula of the moment of inertia of an actual beam will be determined by the cube (or an exponent which is approximately the cube) of the width of the beam multiplied by the thickness of the beam. The overall conclusions of the discussion presented above will therefore apply to the case of a compliant pin in accordance with the invention.

Figures 12, 13, 14, 15, 16:
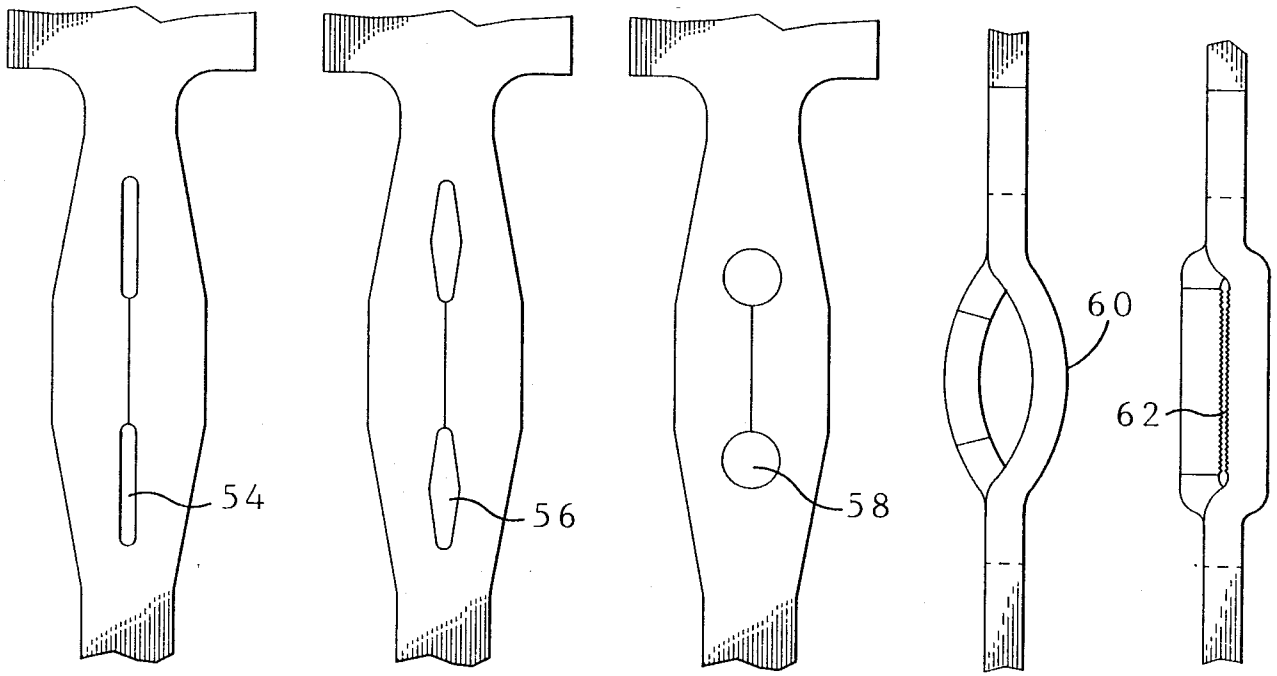

FIGS. 12–14 show hole shapes which will produce varying characteristics the completed pin. In FIG. 12, the holes 54 are in the form of elongated slots, in FIG. 13 the holes 56 are generally elliptical, and in FIG. 14, the holes 58 are circular. In all of these embodiments, the size the openings can be varied to change the characteristics of the beams as desired. It will be apparent that the different opening shapes shown in these figures will produce differing end sections in the beams which will in turn affect the characteristics of the manufactured compliant pin.

FIG. 15 shows an embodiment in which the beams 60 are formed arcuately away from each other and have opposed offset concave surfaces. The ears in this embodiment will initially engage each other at their longitudinal side edges and during movement of the beams in the first reverse directions, these ears will be somewhat flattened prior to stressing of the beams in the second parallel directions. FIG. 16 shows an embodiment in which roughened surfaces 62 are provided on the portions of the ears which overlap and which abut each other when the compliant portion is inserted; into the circuit board hole. These roughened surfaces will also significantly affect the final performance of the compliant pin.

It will be apparent from the foregoing that a compliant pin in accordance with the invention offers the designer of a specific pin a wide variety of options as regards pin performance and material thickness. This adaptability of the pin is based in part on the fact that much of the force which is developed when the pin is inserted into the circuit board hole results from the fact that the beams are flexed parallel to their rolled surfaces and from the fact that the beams are supported intermediate their ends, each beam being supported by the ear of the other beam.

I claim:

1. A contact pin which is destined to be inserted into a circuit board hole, the pin having a compliant portion which is deformed upon insertion and which contacts conductive surface portions of the hole, the contact pin being characterized in that:

the compliant portion has a lead-in portion, a first intermediate portion, and a trailing end portion, the intermediate portion having a width which is greater than the diameter of the circuit board hole, the lead-in portion having a width which is less than the diameter of the circuit board hole the compliant portion being of increasing width between the lead-in portion and the first intermediate portion, the compliant portion being severed along a severing line which extends from the lead-in portion to the trailing end portion, the severing line dividing the compliant portion into a pair of side-by-side beams, each beam having a second intermediate portion, one fixed end at the lead-in portion and another fixed end at the trailing end portion, the second intermediate portions of, the beams being displaced in first opposite directions normally of the longitudinal axis of the pin, and at least one of the beams having a stop portion intermediate its ends, the stop portion of the one beam being adjacent to the severing line and extending towards the other beam whereby, upon movement of the compliant portion into the circuit board hole, lead-in portion first, the beams are moved towards each other in second opposite directions, the second opposite directions normal to the first opposite directions, and the stop means of the one beam is thereby moved into overlapping relationship with the other beam whereby the beams support each other at locations intermediate the ends of the beams, and upon further movement of the compliant portion into the hole the beams are moved further distances in the second opposite directions.

2. A contact pin as set forth in claim 1 characterized in that the compliant portion is of increasing width between the trailing end portion and the first intermediate portion.

3. A contact pin as set forth in claim 1 characterized in that the intermediate portions of the beams are in parallel spaced-apart planes.

4. A contact pin which is destined to be inserted into a circuit board hole, the pin having a compliant portion which is deformed upon insertion and which contacts conductive surface portions of the hole, the contact pin being characterized in that:

the compliant portion has a lead-in portion, an intermediate portion, and a trailing end portion, the intermediate portion having a width which is greater than the diameter of the circuit board hole, the lead-in portion having a width which is less than the diameter of the circuit board hole, the compliant portion being of increasing width between the lead-in portion and the intermediate portion, the compliant portion having a pair of spaced-apart openings therein, one of the openings being proximate to the lead-in portion and the other opening being proximate to the trailing end portion, the compliant portion being sheared along a shear line which extends between the openings, the openings and the shear line dividing the compliant portion into a pair of side-by-side beams, each beam having an intermediate portion, one fixed end at the lead-in portion and another fixed end at the trailing end portion, each beam having an ear which extends from its intermediate portion towards the other beam, the ears being defined by the openings and the shear line, the intermediate portions of the beams being displaced in the first opposite directions normally of the longitudinal axis of the pin and away from each other, the ears being spaced-apart whereby, upon movement of the compliant portion into the circuit board hole, lead-in portion first, and the beams are moved towards each other in second opposite directions, the second opposite directions being normal to the first opposite directions, and the ears are thereby moved into overlapping relationship whereby the ear of each beam functions as a support for the other beam at a location intermediate the ends of the other beam, and upon further movement of the compliant portion into the hole, the beams are moved additional distances in the second opposite directions.

5. A contact pin as set forth in claim 4 characterized in that the pin is a stamped and formed pin having oppositely facing rolled surfaces and sheared side edges, the openings in the compliant portion extending through the rolled surfaces, the beams having a thickness which is determined by the thickness of the stock metal from which the pin was stamped, the width of the beams being the distance from the side edges to the shear line and the openings.

6. A contact pin as set forth in claim 4 characterized in that the compliant portion is of increasing width between the trailing end portion and the intermediate portion.

7. A contact pin as set forth in claim 4 characterized in that the intermediate portions of the beams are in parallel spaced apart planes.

8. A contact pin as set forth in claim 4 characterized in that the openings in the compliant portion are generally triangular, the triangular openings having apices which are adjacent to the leading end and the trailing end each opening having a base which extends normally of, and intersects, the shear line.

9. A contact pin as set forth in claim 4 characterized in that the openings in the compliant portion are circular.

10. A contact pin as set forth in claim 4 characterized in that the openings in the compliant portion are elongated and slot like and have major axes which are aligned with the shear line.

11. A contact pin as set forth in claim 4 characterized in that the openings in the compliant portion are generally elliptical and have major axes which are aligned with the shear life.

12. A contact pin as set forth in claim 4 characterized in that the ears have opposed surfaces which are roughened for friction enhancement.

13. A contact pin as set forth in claim 4 characterized in that the beams extend arcuately between their fixed ends, and the ears have opposed concave surfaces.

14. A contact pin which is inserted into a circular hole in a panel member such as a back panel, the pin having a compliant portion which is in the hole and which is in electrical contact with conductive surface portions of the hole, the pin having a pilot portion which extends from the compliant portion at one end thereof and an adjacent portion which extends from the other end of the compliant portion, the compliant portion having contact edge surfaces which face laterally of the pin axis in opposite directions, the contact pin being characterized the compliant portion has a lead-in portion, an intermediate portion, and a trailing end portion, the intermediate portion being deformed by the hole whereby it maintains the pin in the hole and maintains the contact edge surfaces in contact with the conductive surface portions of the hole, the compliant portion comprising a pair of side-by-side beams, each beam having one fixed end at the lead-in portion and one fixed end at the trailing end portion, the contact edge surfaces being edge surfaces of the beams, the beams being displaced laterally of the pin axis away from each other in first opposite directions whereby portions of the beams are offset in the first opposite directions, the beams being flexed in second opposite directions towards each other, the second opposite directions being normal to the first opposite directions so that the beams have overlapping portions, the overlapping portion of each beam overlapping the other beam and supporting the other beam intermediate its ends.

15. A contact pin as set forth in claim 14 characterized in that each of the beams has an ear extending therefrom towards the other beam, the ears constituting the overlapping portions.

16. A contact pin as set forth in claim 14 characterized in that the contact pin is a stamped and formed pin having oppositely facing rolled surfaces and sheared side edges, each of the beams having a width W which extends across rolled surface portions and a thickness t which is the thickness metal stock from which the pin was stamped, the first opposite directions being directions which are normal to the rolled surfaces, the second opposite directions being directions which are parallel to the rolled surfaces.

17. A contact pin as set forth in claim 16 characterized in that the beams were produced by punching pair of spaced-apart openings in the compliant portion, shearing the compliant portion along a shear line extending between the holes, thereby to form the beams, and then forming the beams laterally of the pin axis in the first opposite directions.

18. A contact pin as set forth in claim 16 characterized in that each of the beams has a transverse cross-section which is generally rectangular and has a a major axis and a minor axis, the major axis extending parallel to the rolled surfaces, the minor axis extending normally of the rolled surfaces.

* * * * *

UNITED STATES PATENT OFFICE

CERTIFICATE OF CORRECTION

Patent No. 4,857,018 Dated August 15, 1989

Inventor(s) Charles S. Pickles

It is certified that error appears in the above-identified patent and that said Letters Patent is hereby corrected as shown below:

In column 8, line 39, claim 1, delete "comma" after the word "of".

In column 8, line 49, claim 1, insert --being-- after "directions".

In column 10, line 2, claim 11, the word "life" should be --line--.

In column 10, line 19, claim 14, add --in that-- after "characterized".

In column 10, line 50, claim 16, insert --of the-- after "thickness".

In column 10, line 56, claim 17, add --a-- after "punching".

Signed and Sealed this

Twenty-sixth Day of June, 1990

*Attest:*

HARRY F. MANBECK, JR.

*Attesting Officer*

*Commissioner of Patents and Trademarks*